United States Patent [19]

Pacault

[11] 3,974,642

[45] Aug. 17, 1976

[54] HYBRID CYCLE POWER PLANT WITH HEAT ACCUMULATOR FOR STORING HEAT EXCHANGE FLUID TRANSFERRING HEAT BETWEEN CYCLES

[75] Inventor: Pierre Henri Pacault, Ville D—Avray, France

[73] Assignee: Fives-Cail Babcock Societe Anonyme, Paris, France

[22] Filed: Jan. 18, 1974

[21] Appl. No.: 434,679

[30] Foreign Application Priority Data

Jan. 26, 1973 France ..... 73.02792
Jan. 26, 1973 France ..... 73.02793

[52] U.S. Cl. ..... 60/39.18 B; 60/39.71; 60/659; 60/655

[51] Int. Cl.[2] ..... F02G 3/00; F02C 3/10; F01K 23/04; F01K 3/02

[58] Field of Search ..... 60/39.18 R, 39.18 B, 60/39.18 A, 39.46, 655, 267, 659, 39.71; 126/400

[56] References Cited

UNITED STATES PATENTS

| | | | |
|---|---|---|---|
| 1,338,750 | 5/1920 | Schranck et al. | 126/400 X |
| 2,586,025 | 2/1952 | Godfrey | 60/267 |
| 3,177,659 | 4/1965 | Berman | 60/39.18 B |
| 3,413,805 | 12/1968 | Heller et al. | 60/655 X |
| 3,796,045 | 3/1974 | Foster-Pegg | 60/39.02 |

FOREIGN PATENTS OR APPLICATIONS

| | | | |
|---|---|---|---|
| 505,044 | 8/1954 | Canada | 60/39.18 B |

*Primary Examiner*—Carlton R. Croyle
*Assistant Examiner*—Thomas I. Ross
*Attorney, Agent, or Firm*—Hopgood, Calimafde, Kalil, Blaustein & Lieberman

[57] ABSTRACT

Installation for producing motive power, operating on a hybrid cycle of gas and vapor such as steam. The installation has a heat accumulator for storing a heat-exchange fluid which can also act as a fluid fuel for a heat source adapted to heat the fluid of the heat accumulator. Heat can be drawn from the accumulator in the form of a flow of hot fluid, for use as required by a motive power producing machine which may be a vapor turbine. Fluid can also be drawn from the accumulator, to act as a fuel for the heat source, supplementary fluid being supplied to the accumulator to make up for the amount drawn off, whereby the accumulator contents are continuously renewed, to reduce thermal decomposition of the fluid fuel. The heat source can be a gas turbine for producing a basic power output, the turbine exhaust gases being used to heat the heat-exchange fluid by way of a heatexchanger connected to the heat accumulator. The installation can be used in a station for generating an electrical power supply for a distribution network with fluctuating power demands.

16 Claims, 4 Drawing Figures

HYBRID CYCLE POWER PLANT WITH HEAT ACCUMULATOR FOR STORING HEAT EXCHANGE FLUID TRANSFERRING HEAT BETWEEN CYCLES

BACKGROUND OF THE INVENTION

Power stations for supplying power to a distribution network have been described, which are provided with an installation for the storage and restoration of heat energy produced by the heat source, in order to meet fluctuations in the power demands made by the network. Thus, during periods of low power demand, the excess of heat produced by the basic heat source of the station is stored or put into reserve so that the stored heat in the reserve can be used during periods of high power demand.

Also, some stations adapt to fluctuations in a variable-demand power network by utilising a basic motive power producing installation operating with a vapour cycle, and an auxiliary installation operating with a gas cycle, to supplement the basic installation to meet the power demands. The exhaust gases from the auxiliary installation are utilised to supply heat to the basic installation, for example in the combustion chamber of the boiler or in a heat recovery means, an air reheater or a water reheater.

Power generating stations have also been described, in association with a heat accumulator and a heat source using a fossil or nuclear fuel. Examples of such installations include stations for producing a motive power, with a gas or stream cycle, with a boiler which is heated by a combustion chamber or a nuclear reactor. Such stations are connected to a variable-demand electricity distribution network and, to meet variations in power demand, they are provided with an accumulator which is capable of storing the excess heat produced by the heat source during periods of low demand on the network, and restoring the stored heat to the power-producing cycle during peak periods.

The heat accumulator can be in the form of a heat-exchange fluid reservoir and a heat exchanger which are mounted in series on a closed circuit with continuous circulation of the heat-exchange fluid through the circuit. In the heat exchanger there occurs a heat exchange, by means of heat-exchange surfaces, between the heat-exchange fluid and another fluid which is at a higher or lower temperature relative to the heat-exchange fluid, depending on whether the installation is in the heat storage or the heat restoration mode. In storage periods, the heat-exchange fluid is heated by heat transfer from the other fluid, and returned to the upper regions of the reservoir, which are at a relatively higher temperature. In restoration periods the hot heat-exchange fluid is drawn off from the upper regions of the reservoir and, after being cooled by heat exchange in the heat-exchanger where it transfers heat to the other fluid, it is returned to the lower regions of the reservoir, which are at a relatively lower temperature.

The heat exchanger can comprise one or more sections, but in all the arrangements referred to, the basic principle of the installation is an alternate succession of heating and cooling a heat-exchange fluid circulating in a single closed circuit. It has been proposed that the heat-exchange fluid can be a saturated hydrocarbon, which however should only be heated to a temperature which is substantially lower than its decomposition temperature, in order to ensure that the installation enjoys good operating conditions. In practice, this results in reservoirs being of substantial volume.

SUMMARY OF THE INVENTION

An object of the present invention is to provide a thermal installation for producing a motive power, on a hybrid gas-vapour cycle, which is capable of adaptation to variations in demand made by a power network to be operated by the installation, while removing or reducing to the minimum disturbances in operation of the cycle caused by such variations.

Another object of the present invention is to provide an installation for generating a driving force, which does not require reservoirs for heat accumulation, which are of substantial volume, thereby effecting a reduction in the size of the installation, while providing a higher degree of efficiency in the heat exchanges between fluids.

Yet another object of the present invention is to provide a motive power producing installation having a gas turbine for producing the driving force, with the arrangement of the installation being such that the gas turbine can operate at a constant power ouput level, and thus at its maximum efficiency, without the need for the power output of the turbine to be reduced or increased to meet fluctuating demands thereon.

A still further object of the present invention is to provide such an installation which has a heat accumulator for storing a heat-exchange fluid in the form of a fuel, for a gas turbine, such as a saturated hydrocarbon fuel, which can be stored in the heat exchanger at a temperature which is only slightly below or even slightly above the decomposition temperature of such a fuel, to improve the heat-exchange efficiency of the installation.

With these and other objects in mind, in one aspect of the invention a thermally operated installation for producing a motive power force on a hybrid gas-vapour cycle comprises a gas turbine for driving a load, and a heat accumulator or reservoir for storing heat drawn from the exhaust gases of the gas turbine. Operatively connected to the heat accumulator is a vapour or steam generator which can draw heat from the heat accumulator, for supplying vapour or steam to a vapour or steam turbine for driving an additional load. The loads can be for example alternating-current generators, for feeding electrical power to a variable demand electrical power distribution network. When the power demand is high, the additional vapour or steam turbine can be brought into operation by drawing heat from the heat accumulator and using the heat to produce vapour or steam for driving the turbine.

The heat from the exhaust gases of the gas turbine can be taken therefrom by heat-exchange in a heat exchanger through which a heat-exchange fluid also flows, the heated heat-exchange fluid being returned to the heat accumulator which is in the form of a reservoir for the fluid. The heat-exchange fluid flows in a closed circuit in series through the reservoir and the heat exchanger. In another circuit, the heated heat-exchange fluid can be drawn from the reservoir and passed through the vapour or steam generator, which can also be in the form of a heat exchanger, to heat water which is passed into the generator. This water is converted into steam used to drive the additional steam turbine. Heat-exchange fluid to be heated in the heat exchanger by heat transfer from the gas turbine exhaust gases is advantageously drawn from the lower region of the reservoir, and returned to the upper region thereof, while heat-exchange fluid drawn from the reservoir to heat the steam or vapour generator is advantageously drawn from the upper region of the reservoir and returned to the lower region thereof. The reservoir can include collector-distributor assemblies at its upper and lower regions, to ensure that heat-exchange fluid is drawn from and returned to the reservoir, over a horizontal plane occupying substantially the whole of the cross-sectional area of the reservoir.

The installation can further include a conduit for drawing heat-exchange fluid, which is in the form of a fuel, from the heat accumulator or reservoir, and supplying it as fuel to a combustion chamber for the gas turbine. The heat accumulator or reservoir thus acts both as a heat-exchange fluid reservoir and as a supply source for fuel for the gas turbine operation. A reserve tank can be connected to the heat accumulator or reservoir, for replacing the amount of fuel fluid drawn from the reservoir and passed to the combustion chamber, so that the contents of the heat accumulator are constantly renewed. This makes it possible for the temperature of the heat-exchange fluid fuel in the heat accumulator to be maintained at a temperature which is very close to the temperature of decomposition of the fluid.

This arrangement enables the gas turbine to operate at a constant mode of power output, and affords the auxiliary steam or vapour generator a heat source which, by including a heat accumulator, is capable of operating without disturbance over a wide range of heat flow rates.

DESCRIPTION OF THE PREFERRED EMBODIMENTS

Figure 1:
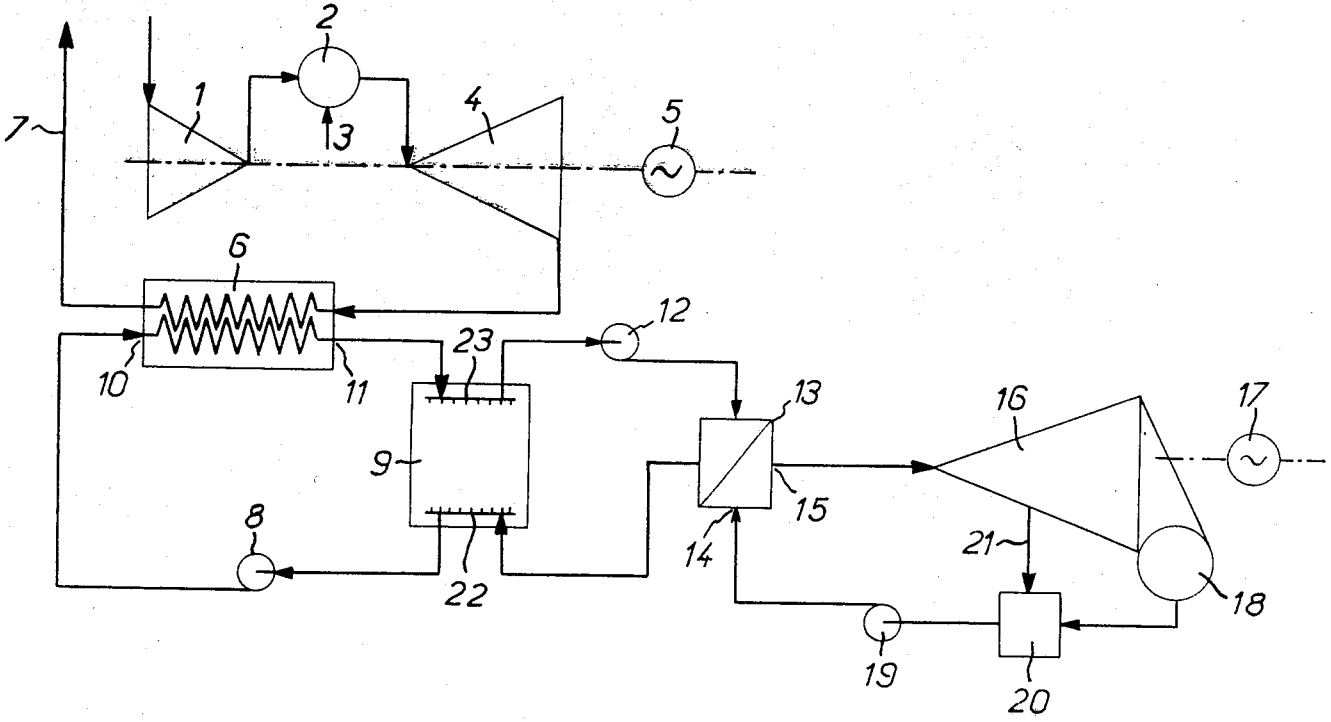
FIG. 1 is a diagrammatic view of a first embodiment of the installation for producing a motive power according to the invention.

Referring firstly to FIG. 1, the installation has an air compressor 1 for supplying compressed air to a combustion chamber 2. Reference numeral 3 indicates a fuel intake means for supplying fuel to the combustion chamber 2. Combustion products discharged from the combustion chamber 2 are passed to a gas turbine 4 for driving a load in the form of an alternator 5. The exhaust gases from the turbine 4 are circulated through a heat exchanger 6 and from there passed for discharge by way of a chimney 7. The exhaust gases give up their heat to a heat-exchange fluid circulating in counterflow in the heat exchanger 6. This heat-exchange fluid is drawn by a pump 8 from the lower region of a reservoir 9, the lower regions being relatively cool, and is introduced into the heat exchanger 6 at inlet 10. The heat-exchange fluid is heated by heat transfer from the gas turbine exhaust gases, and is discharged at a higher temperature from the heat exchanger 6 at outlet 11. The heat-exchange fluid is then returned to the upper regions of the reservoir 9, the upper regions being therefore at a relatively high temperature. The heat-exchange fluid is passed into and drawn from the lower part of the reservoir 9 by a collector-distributor assembly 22 which draws fluid from the reservoir uniformly over a horizontal plane which occupies substantially the whole of the cross-sectional area of the reservoir 9, and also returns the fluid to the reservoir in a similarly uniform manner, as will be described hereinafter. A similar collector-distributor assembly 23 fulfils the same purpose as regards the inflow and outflow of hot heat-exchange fluid at the upper part of the reservoir 9.

Also connected to the upper part of the reservoir 9 by way of the assembly 23 is a pump 12 which is operable to draw off heat-exchange fluid as required from the upper regions of the reservoir 9 and circulates it as a heating fluid in a heat-exchanger or generator 13, for producing steam. The generator 13 has a water inlet 14 and a steam outlet 15. The heat-exchange fluid is cooled by heat exchange in the generator 13 from which it is returned to the lower cooler regions of the reservoir 9, the heat transferred from the fluid to the water introduced through the inlet 14 converting the water to steam.

The steam produced by the generator 13 is passed to a turbine 16 connected to a load 17 to be driven by the turbine, and the steam expands in the turbine 16, thereby driving the load 17, until the steam reaches the pressure level in condenser 18. A pump 19 returns the condensate from the condenser 18 to the stream generator 13 after the condensate has been circulated through a water station 20 which is supplied by way of a tapping 21 from the turbine 16.

In this installation, the gas turbine 4 can operate at a constant output to provide a basic drive force output to drive the load 5; in addition the heat of the exhaust gases is stored by means of the heat-exchange fluid in the reservoir 9, from which the stored heat can be supplied as required to bring the auxiliary vapour cycle installation (the turbine 16 and associated components) into operation, to provide an additional output of driving force to drive the additional load 17. Variations in the output of heat from the reservoir 9 result in simple variations in the flow rate of the heat-exchange fluid through pump 12 and generator 13, without affecting the operating mode of the generator 13 as the generator 13 receives the heating fluid from the reservoir 9 at a temperature which is virtually constant, at least until the heat stored in the reservoir 9 is virtually exhausted. Due to the above-described manner in which the heat-exchange fluid is introduced into and drawn from the reservoir 9, the colder fluid tends to remain in horizontal layers at the bottom of the reservoir, without mixing with the layers of hotter fluid which tend to remain in the upper part of the reservoir 9.

Figure 2:
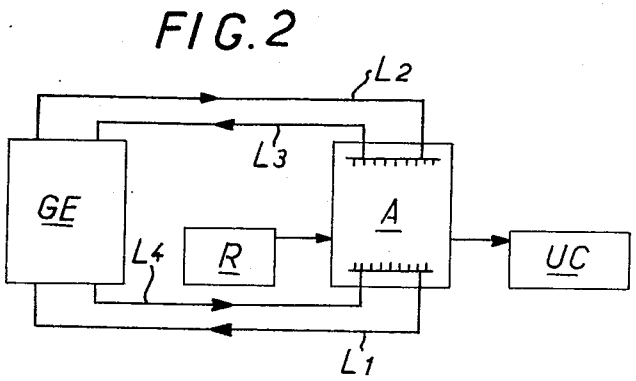
FIG. 2 is a view in the form of a schematic operating diagram of a second embodiment of the installation.

Referring now to FIG. 2, a power generating installation GE is supplied with heat from any suitable heat source, using for example a fossil or nuclear fuel or the like. Connected to the installation GE is a heat accumulator A which is in the form of a reservoir for a heat-exchange fluid.

The installation GE is required to supply power to a variable demand network. At slack periods, when the demand for power is low, the heat source produces more heat than that required to satisfy the demand made by the network, and the excees heat produced is used to heat the heat-exchange fluid which is taken by way of a line L1 from the lower, cooler regions of the accumulator A. The heat-exchange fluid, after being heated by the excess heat produced by the heat source, returns by way of line L2 to the upper regions, which are at a relatively higher temperature, of the accumulator A.

In peak periods, when the power demand on the network is high, the accumulator A restores to the installation GE heat which has been accumulated in the accumulator, such restored heat being supplied in the form of a flow of heat-exchange fluid which is taken off by way of a line L3 from the upper part of the accumulator A. The heat of this fluid is added to that supplied by the heat source which is producing heat at its nominal or maximum output, to satisfy the total power demand of the network. The heat-exchange fluid which has given up its heat in the installation GE returns to the lower cooler regions of the accumulator A by way of line L4.

The heat-exchange fluid is a hydrocarbon which is supplied to the accumulator A from a reserve tank R, with a continuous or intermittent flow. Fluid is drawn from the accumulator A at a flow rate equal to the flow rate to the accumulator A from the reserve R, and passed, as fuel, to an installation UC for utilising heat. The installation UC can comprise for example an auxiliary gas turbine or a boiler supplying an ancilliary vapour turbine. The supply of fuel to the installation UC through the accumulator A provides for a continuous or intermittent renewal of the fuel content of accumulator A, thereby the fuel fluid forming the heat source for the installation UC can be stored in the accumulator A at a relatively elevated temperature, which would be considered unacceptable in the absence of such renewal of the accumulator fuel contents, because of the danger of the accumulation of decomposition products of the heat-exchange fluid, caused by the relatively elevated temperature. In other words, the renewal of the content of the accumulator maintains the proportion of fuel decomposition products therein, at an acceptable level.

In the embodiment illustrated in FIG. 3 to which reference will now be made, an air compressor 31 supplies compressed air to a combustion chamber 32 which is provided with an intake 33 for a liquid fuel. Combustion products from the combustion chamber 32 are passed to a gas turbine 34 for driving a load in the form of an alternator 35. The exhaust gases from the turbine 34 circulate through a heat exchanger 36 with heat-exchange surfaces, before being discharged by way of a chimney 37.

Within the heat exchanger 36 the exhaust gases from the turbine 34 circulate in counter-flow to a heat-exchange fluid to which the gases give up heat. The fluid is a liquid fuel and preferably a saturated hydrocarbon. The heat-exchange fluid supplied to the heat exchanger 36 is drawn off by means of a pump 38 from the lower cooler regions of a heat accumulator or reservoir 39, while after the fluid has been heated in the exchanger 36, it returns to the reservoir 39 in the upper, hotter part thereof.

A pump 40 draws hot heat-exchange fluid as required from the upper regions of the reservoir 39, and circulates it as a heating fluid in a heat-exchanger or steam or vapour generator 41 which has a water inlet and a vapour outlet. After passing through the generator 41 the cooled fluid returns to the lower, cooler regions of the reservoir 39. The vapour produced by the generator 41 is used to drive a vapour turbine for supplying a make-up amount of power, to supplement the power produced by the turbine 34, when the power demand is high. Reference numeral 42 denotes the turbine assembly including turbine, load, condenser and other components.

A reservoir 43 contains a fluid reserve which serves both as a reserve of heat-exchange fluid for the circuit comprising components 36, 38 and 39, and as a reserve of fuel for the combustion chamber 32 of the installation. The reservoir 43 successively supplies fluid in series to the reservoir 39 and to the combustion chamber 32. For this purpose a pump 44 is arranged to pass fluid from the reservoir 43 to the reservoir 39, and a further pump 45 is arranged to pass fluid from the reservoir 39 to the combustion chamber 32. The two pumps 44 and 45 have the same output rate, which is equal to the fuel consumption in the combustion chamber 32, so that the fraction of fuel which serves as a heat-exchange fluid is being constantly renewed in the reservoir 39 and in this way can be raised to a temperature which is close, either below or slightly above, to the decomposition temperature of the heat-exchange fluid.

Figure 3:
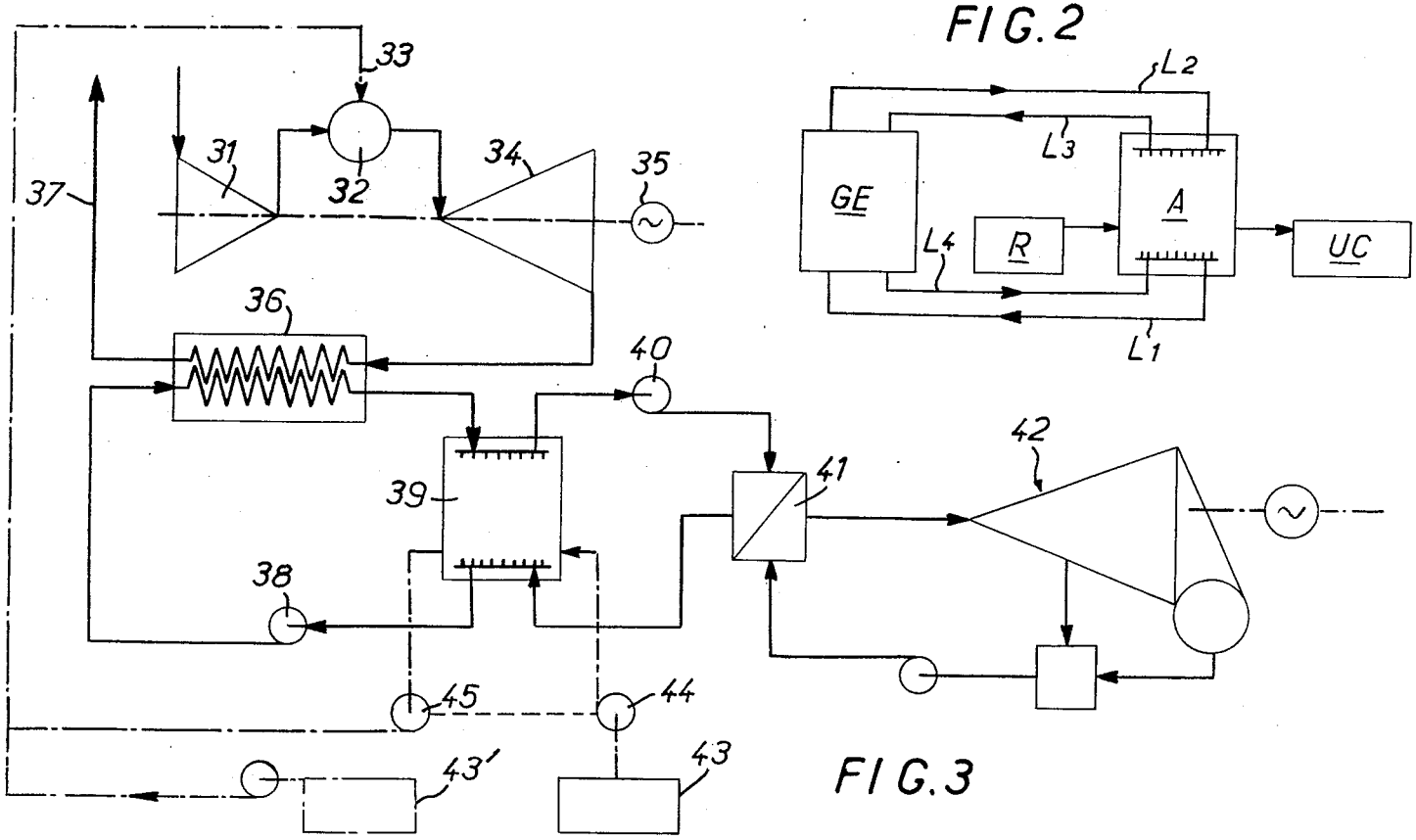
FIG. 3 is a diagrammatic view of a third embodiment of the installation according to the invention.

In a modified form of this arrangement, as shown also in FIG. 3, a further reserve reservoir 43' which can be brought into operation at the same time as the reservoir 43 supplies fluid directly to the combustion chamber 32, in order to maintain in the reservoir 39 only a suitable rate of fluid contents renewal, which is not unnecessarily higher than that required to ensure that its contents remain sufficiently unaffected by possible thermal decomposition.

Figure 4:
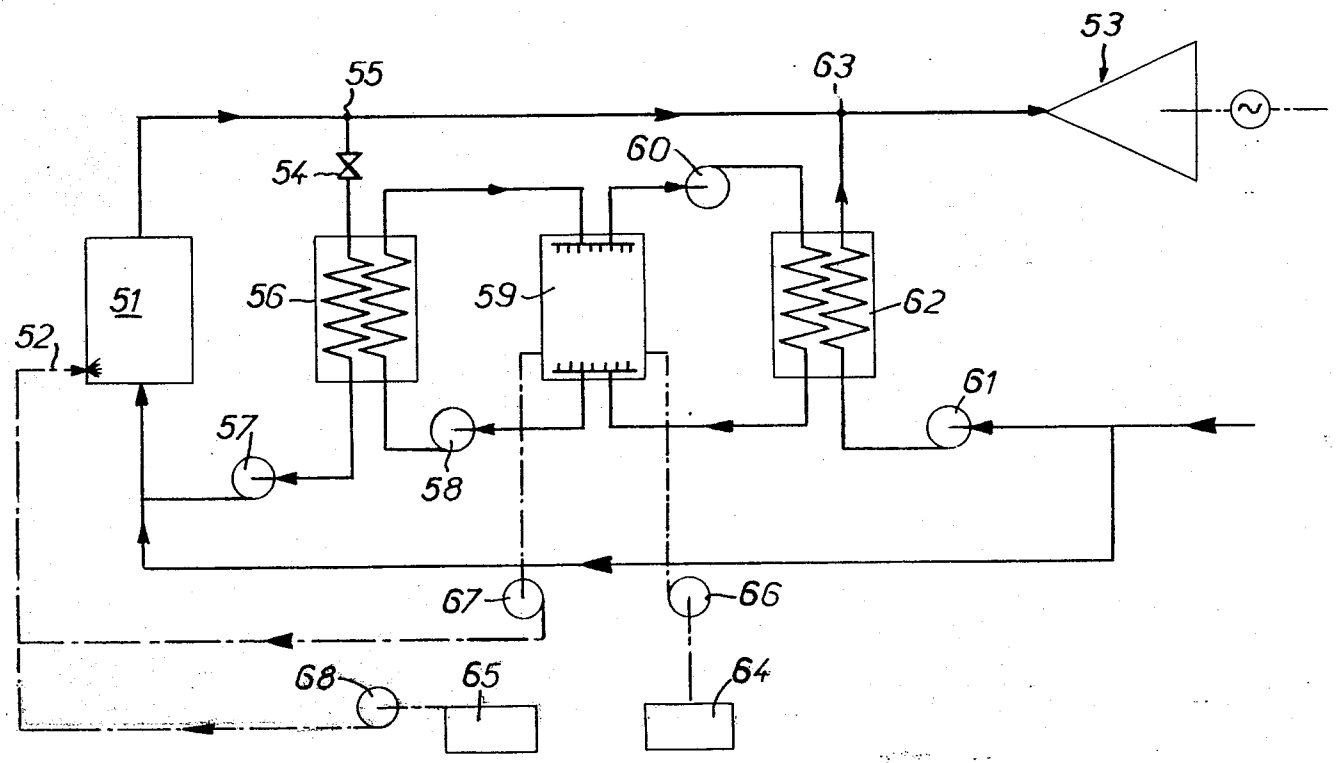
FIG. 4 is a diagrammatic view of a fourth embodiment of the installation, with a vapour cycle and using a fossil fuel, according to the invention.

Referring now to FIG. 4, this embodiment of the installation has a steam generator 51 in the form of a boiler with burners 52 for supplying live steam to a power generating installtion 53 including a steam turbine for driving a load in the form of an alternator.

At slack periods when the power demand is low, a valve 54 is opened to draw off from the steam supply line through connection 55, a part of the steam supplied to the turbine by the generator 51. The steam flow drawn off in this way circulates as a heating fluid in a surface heat exchanger 56 and is condensed therein, the condensate being returned by means of a pump 57 to the boiler 51. In practice, the steam which is drawn off to act as a heating fluid will preferably be partially expanded steam which will already have performed a certain amount of work.

Within the heat exchanger 56, the live steam gives up its heat to a heat-exchanger fluid which can be a liquid hydrocarbon and which a pump 58 draws from the lower, cooler regions of a heat accumulator or reservoir 59. The heat-exchange fluid is circulated and thereby heated in the heat exchanger 56, and then returned to the upper regions, which are at a relatively high temperature, of the reservoir 59.

At peak periods when the power demand is high, the valve 54 is closed and the pumps 57 and 58 are stopped. All the live steam produced by the generator 51 is passed to the installation 53, to be converted into mechanical power. To increase the amount of mechanical power produced, beyond the maximum levels of production capacity of the generator 51, the installation also has a pump 61 supplying water to an auxiliary steam generator or heat exchanger 62 which uses the heat-exchange fluid from the reservoir 59 as a heating fluid. A pump 60 is connected to the reservoir 59 to draw off heat-exchange fluid from the upper, hotter regions of the reservoir 59, and return it to the lower regions of the reservoir 59, after the fluid has passed through the generator 62 in which heat from the heat-exchange fluid heats the water supplied by the pump 61, and converts the water into steam. The steam output from the generator 62 is added, by means of connection 63, to the live steam supplied by the generator 51, the total steam flow thus being supplied to the turbine of the installation 53.

The installation shown in FIG. 4 also includes a reserve reservoir 64 for heat-exchange fluid, and reserve reservoir 65 for fuel, which fuel may or may not be the same as the heat-exchange fluid. A pump 66 draws heat-exchange fluid from the reservoir 64 and passes it to the reservoir 59. At the same time, at the same flow rate, a pump 67 draws heat-exchange fluid from the reservoir 59 and passes it as a fuel to the burners 52. Added to this supplementary fuel flow is the fuel flow drawn off by a pump 68 from the reservoir 65.

This arrangement makes it possible to renew the heat-exchange fluid contained in the reservoir 59, to the extent required to limit the proportion of decomposition products in the reservoir 59, or totally to remove such products, although it is not intended that the burners of the boiler should be limited to using only this fluid as fuel.

The above-described arrangement also makes it possible very substantially to reduce the margin between the heat storage temperature and the decomposition temperature of the heat-exchange fluid, without impairing either safety or good operation of the installation. With a decomposition temperature of 350°C, a heat storage temperature of approximately 320°C can be envisaged, without danger.

In the accumulators 39 and 59, known means such as deflectors or baffle-plate assemblies can be used to prevent the inflows and outflows of fresh heat-exchange fluid and fuel fluid from disturbing the distribution of fluid, on the basis of temperature of the stored fluid, in the vertical direction of the accumulators. To take the example of the installation shown in FIG. 3, other means intended for the same purposes can comprise injecting the fresh fluid from the pump 44 into the conduit which connects the exchanger 41 to the accumulator 39, supplying the combustion chamber 32 with fuel drawn from the conduit portion which connects the pump 38 to the heat exchanger 36, or mounting the reservoir 43 in series on the conduit which connects the exchanger 41 to the accumulator 39, and/or on the conduit which connects the accumulator 39 to the pump 38.

The invention is not limited to the particular and specific uses and arrangements as described above and shown in the accompanying drawings, as various modifications can be made without thereby departing from the invention. Such modifications are therefore to be understood as being within the spirit and the scope of the invention.

What is claimed is:

1. A motive-power-producing installation, comprising a gas turbine with an exhaust outlet, a heat accumulator adapted to store heat and including an upper-region inlet and a lower-region outlet, means including a heat-exchanger connected to said turbine-exhaust outlet for transferring heat from turbine-exhaust gases to said heat accumulator and increasing the heat content thereof, said transferring means comprising a series-connected fluid-flow circuit from said lower-region outlet to said upper-region inlet via said heat-exchanger, a vapor generator with a vapor turbine operatively connected thereto, and selectively operable fluid-flow means independent of said transferring means and connecting said accumulator and vapor generator for selectively withdrawing heat from the heat accumulator and supplying it to said vapor generator, whereby said vapor generator may be selectively operated independently of the input of heat to said accumulator.

2. A motive-power producing installation, comprising:

a. a gas turbine with an exhaust-gas outlet;
b. a heat accumulator comprising a reservoir having a lower region and an upper region and filled with heat-transfeer fluid;
c. a heat exchanger;
d. a vapor generator and a vapor turbine operatively connected therewith;
e. means connecting said exhaust-gas outlet to said heat exchanger for circulating exhaust gases therethrough;
f. first fluid-circulation means connecting said lower reservoir region to said upper reservoir region via said heat exchanger, for circulating heat-transfer fluid from said lower region to said upper region by way of said heat exchanger; and
g. second fluid-circulation means connecting said upper reservoir region to said lower reservoir region via said vapor generator, for selectively circulating heat transfer fluid from said upper region to said lower region by way of said vapor generator.

3. A motive-power-producing plant, comprising:

a. combustor;
b. heat-using means for using fuel-generated heat;
c. a heat accumulator comprising a reservoir having a lower region and an upper region and filled with liquid fuel;
d. a heat exchanger;
e. a vapor generator and a vapor turbine operatively connected therewith;
f. means connecting said combustor to said heat exchanger for supplying heat thereto;
g. first fluid-circulation means connecting said lower reservoir region to said upper reservoir region via said heat exchanger, for circulating liquid fuel from said lower region to said upper region by way of said heat exchanger;
h. second-fluid-circulation means connecting said upper reservoir region to said lower reservoir region via said vapor generator, for circulating liquid fuel from said upper region to said lower region by way of said vapor generator;
i. means for drawing off fuel from said reservoir and supplying it to said combustor; and
j. means for restoring to said reservoir an amount of fuel substantially equal to that drawn off.

4. An installation according to claim 3 wherein said vapor turbine is an auxiliary motive power-generating unit.

5. An installation according to claim 3 wherein said fluid supplying and restoring means are operable continuously.

6. An installation according to claim 3, and further comprising a fuel-supply source connected for the direct supply of fuel to said combustor.

7. An installation according to claim 3, wherein said heat-using means is a gas turbine and said combustor is adapted to be supplied with fuel at least in part from said heat accumulator.

8. An installation according to claim 7, wherein said gas turbine has an exhaust connection to said heat accumulator for using heat from the turbine exhaust gases, to heat the fluid in said accumulator.

9. A motive-power-producing plant, comprising:

a. a gas turbine installation including a combustion chamber and an exhaust-gas outlet;

b. a heat accumulator comprising a reservoir having a lower region and an upper region and filled with liquid fuel;

c. a heat exchanger;

d. a vapor generator and a vapor turbine operatively connected therewith;

e. means connecting said exhaust-gas outlet to said heat exchanger for passing exhaust gases therethrough;

f. first fluid-circulation means connecting said lower reservoir region to said upper reservoir region via said heat exchanger for circulating liquid fuel from said lower region to said upper region by way of said heat exchanger;

g. second fluid-circulation means connecting said upper reservoir region to said lower reservoir region via said vapor generator, for selectively circulating liquid fuel from said upper region to said lower region by way of said vapor generator;

h. means for drawing off fuel from said reservoir and supplying it to said combustion chamber; and i. means for restoring to said reservoir an amount of fuel substantially equal to that drawn off.

10. An installation according to claim 9, wherein said heat exchanger has first heat-exchange means in closed-circuit fluid-flow communication with said reservoir, and second heat-exchange means connected to said exhaust outlet and to said first heat-exchange means for conducting a flow of gas-turbine exhaust gases for heating the fluid flow in said first heat-exchange means, the exhaust gases and the fluid fuel being in counter-flow to each other in the heat exchanger, whereby fuel from the reservoir takes up heat from the exhaust gases by circulating in the heat exchanger and returns to the reservoir.

11. A motive-power-producing plant, comprising:

a. a gas turbine installation with a gas turbine having an exhaust-gas outlet;

b. a heat accumulator comprising a reservoir having a lower region and an upper region and filled with liquid fuel;

c. a heat exchanger;

d. a vapor generator and a vapor turbine operatively connected therewith;

e. means connecting said exhaust-gas outlet to said heat exchanger for passing exhaust gases therethrough;

f. first fluid-circulation means connecting said lower reservoir region to said upper reservoir region via said heat exchanger, for circulating liquid fuel from said lower region to said upper region by way of said heat exchanger;

g. second fluid-circulation means connecting said upper reservoir region to said lower reservoir region via said vapor generator, for circulating liquid fuel from said upper region to said lower region by way of said vapor generator;

h. a fuel-using means;

i. means for drawing off fuel from said reservoir and supplying it to said fuel-using means; and j. means for restoring to said reservoir an amount of fuel substantially equal to that drawn off.

12. A power plant, comprising:

a. a gas turbine installation with an exhaust-gas outlet;

b. a vapor turbine installation with a vapor generator; and c. a heat accumulator containing heatable material and having capacity for storing freshly-heated and relatively unheated quantities of said material in separate regions thereof; said accumulator having first means containing heatable material and including a heat-transfer device connected to said exhaust-gas outlet for supplying heat from said exhaust gases to heatable material and thence to the freshly-heated region, and selectively operable second means connecting said vapor generator to said accumulator at the freshly heated region thereof for extracting heatable material from the freshly heated region and supplying said extracted heatable material to heat said vapor generator, whereby said accumulator may accumulate heat via said heat-transfer device while said heat-extraction means is inoperative.

13. An installation according to claim 12, wherein the heatable material is a heat-exchange fluid and said heat accumulator comprises a reservoir for storing the heat-exchange fluid.

14. An installation according to claim 13, wherein the freshly heated region is an upper region of said reservoir and the relatively unheated region is a lower region of said reservoir, and means for drawing heatable material from the lower region of said reservoir and passing it to said heat-transfer device, to thereby complete a circulation path via said heat-transfer device.

15. An installation according to claim 14, wherein said reservoir has inlet means and outlet means for circulated extracted-heat flow of heatable material between said reservoir and said vapor generator.

16. An installation according to claim 12 wherein the vapor turbine is a steam turbine.

* * * * *